US006457595B1

(12) United States Patent
Pritchard et al.

(10) Patent No.: US 6,457,595 B1
(45) Date of Patent: Oct. 1, 2002

(54) CONFIGURABLE SHELVING/STORAGE SYSTEM

(75) Inventors: David Mark Pritchard, Gurnee, IL (US); Antonio Vardaro, Montreal (CA)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/440,564

(22) Filed: Nov. 15, 1999

Related U.S. Application Data

(60) Provisional application No. 60/108,727, filed on Nov. 17, 1998.

(51) Int. Cl.[7] ..... A47B 43/00

(52) U.S. Cl. ..... 211/189; 211/190; 108/108

(58) Field of Search ..... 211/189, 175, 211/182, 184, 190, 194; 108/108, 55.1, 56.3

(56) References Cited

U.S. PATENT DOCUMENTS

| | | | | |
|---|---|---|---|---|
| 2,965,242 | A | | 12/1960 | Grotke |
| 2,991,889 | A | | 7/1961 | Levy et al. |
| 3,160,281 | A | | 12/1964 | Ruhnke |
| 3,502,292 | A | | 3/1970 | Yoder |
| 3,750,893 | A | | 8/1973 | Kempler |
| 3,971,477 | A | | 7/1976 | Bruderly et al. |
| 4,046,083 | A | | 9/1977 | Murdoch et al. |
| 4,068,855 | A | | 1/1978 | Hackett |
| 4,127,196 | A | | 11/1978 | Boucher |
| 4,199,069 | A | | 4/1980 | Talarico |
| 4,693,383 | A | | 9/1987 | Fenwick |
| 4,744,475 | A | | 5/1988 | St. Pierre |
| 4,829,977 | A | | 5/1989 | Valentine |
| 4,919,282 | A | | 4/1990 | Duff et al. |
| 5,127,341 | A | | 7/1992 | Wiklund |
| 5,255,803 | A | | 10/1993 | Pavone et al. |
| 5,257,794 | A | * | 11/1993 | Nakamura ..... 211/182 |
| 5,372,262 | A | | 12/1994 | Benson et al. |
| 5,407,262 | A | | 4/1995 | Christian et al. |
| 5,529,192 | A | | 6/1996 | Conen et al. |
| 5,566,844 | A | | 10/1996 | Bernardin |
| 5,573,124 | A | | 11/1996 | Frost |
| 5,605,238 | A | | 2/1997 | Jacobs |
| 5,607,070 | A | | 3/1997 | Hellyer |
| 5,697,507 | A | | 12/1997 | Blass |
| 5,722,544 | A | | 3/1998 | Williams |
| 5,918,750 | A | | 7/1999 | Jackson |

* cited by examiner

*Primary Examiner*—Peter M. Cuomo
*Assistant Examiner*—Jerry A. Anderson
(74) *Attorney, Agent, or Firm*—Michael Best & Friedrich LLC

(57) ABSTRACT

A system including modular components by which the system may be configured and reconfigured easily and quickly for the shelving or the storage of merchandise for the retail industry and other applications as needed and without the need for tools and conventional removable fastening means. The modular system includes a generally horizontal base and at least one vertical panel that can be easily and quickly releasably secured in one or other positions relative to the base. Preferred embodiments of the system include those having a base having securement apertures structured such that the vertical panel or panels may be releasably secured to the base without the need for conventional removable mechanical fasteners and tools and so that even an unskilled individual can quickly and easily arrange and rearrange the vertical panels relative to the base in a wide variety of possible useful configurations.

19 Claims, 13 Drawing Sheets

CONFIGURABLE SHELVING/STORAGE SYSTEM

This application is based on and claims benefit of U.S. provisional application Ser. No. 60/108,727 filed on Nov. 17, 1998.

FIELD OF THE INVENTION

The subject invention relates to a system for shelving and/or storing. More particularly, the invention relates to a relatively lightweight and simplified modular system that includes components by which the system may be configured and reconfigured easily and quickly for the shelving or the storage of merchandise for the retail industry and other applications as needed and without the need for tools and conventional removable fastening means.

BACKGROUND OF THE INVENTION

A variety of apparatus and systems are known for the shelving and/or storage of an item or items such as for retail sale to the public. Many of such apparatus and systems include components such that the system can be arranged in only a single or a limited number of configurations. Characteristically such systems use one or more vertical standards or panels that are maintained in a vertical position by fixing the standard to a wall or to the floor through conventional fastening means—such as bolts, nuts, screws, snap buttons, or other types of mechanical fasteners. Some such conventional systems include a base unit to maintain the vertical standards or panels in a vertical position. Typically, the vertical standards or panels are fixed to the base unit such as by welding or secured to the base unit by the receipt of a portion or portions of the vertical standards or panels into a one of a limited number of positions along the base unit and the fastening of the portions into the positions in the base by conventional removable fasteners. Bolts and nuts, screws, and snap buttons are just some of the many known removable mechanical fasteners typically used to secure the vertical standards or panels to a base unit or hold the components in position. Tools such as screwdrivers—powered or otherwise—and wrenches are commonly used to engage, tighten, or otherwise operate the conventional fastening means until tightened or otherwise held in place. Vertical units may be fixed to a base in known systems also by nonremovable means such as by the welding or other permanent means of attachment. The vertical standards of such conventional systems characteristically supports one or only a limited number of types of display or shelving hardware such as shelves and/or bracket/shelf combinations in a limited number of positions relative to the vertical units.

A number of disadvantages are associated with the conventional shelving/storage systems. Overall, the components of each of these systems are sized, shaped, and structured such that the system can be arranged in only a very limited number of configurations. This is particularly true of conventional systems that utilize vertical standards that must be secured to a wall for support and those that are secured to a base that provides only a limited number of securing points. Conventional shelving/storage systems that require the use fasteners to fix the components of the system relative to each other are also disadvantageous in that such systems are relatively more costly to produce. This is, in part, due to the increased amount of material and processing cost to make the fastening pieces but also due to the increased amount of labor needed to ensure that the system has the proper number and variety of fasteners before the system is packaged and sold to consumers. Shelving/storage systems having components that must be secured to each other with the use of tools are overall more costly also because the manufacturer must provide such tools with the system or the consumer must purchase the tools in order to assemble the system. When the cost of the labor needed to construct and reconfigure such multiple fastener systems is considered, the overall cost to employ such conventional systems increases. The actual labor cost depends upon the complexity of the system, the number of fasteners that are used to secure the components together, and whether skilled or unskilled individuals attempt to configure or reconfigure the system. Conventional systems that use multiple fasteners to secure the system together are additionally disadvantageous in that a suitably reliable storage place must be found to accommodate all of the fasteners and tools when the system is disassembled. The loss of any of fastener or tool that is unique to the system typically prevents the system from being reconstructed as before.

A demand therefore exists for a shelving/storage system that includes components by which the system may be configured and reconfigured easily and quickly by even a generally unskilled individually without the need for conventional fastening means or tools. The present invention satisfies this demand.

SUMMARY OF THE INVENTION

The present invention is directed to a modular shelving/storage system including components by which the system may be configured easily and quickly as needed without the use of conventional separable mechanical fasteners and generally without the need for any tools.

Specifically, the new system includes a generally horizontal base and at least one vertically-aligned panel that can be easily and quickly releasably secured in one or other positions relative to the base. Preferred embodiments of the system include those having a base structured such that the vertical panel or panels can be releasably secured to the base without the need for conventional separable mechanical fasteners and tools and so that even an unskilled individual can quickly and easily arrange and rearrange the vertical panels relative to the base in a wide variety of possible useful configurations.

One preferred embodiment of the system includes a base having at least one set of apertures that open through the upper surface of the base generally adjacent to the upper base edge, each aperture of which is sized and shaped to receive and releasably secure an extension of a lower end of a post of an outer panel. Other embodiments of the base include additional sets of post apertures such that one or more additional outer panels may be releasably secured to upper surface of the base. The base may include also at least two sets of opposing bracket slots—aligned generally adjacent to but spaced from opposing upper edges of the base, each slot of which is sized and shaped to accommodate and secure without the use of known fasteners or tools a portion or the entire lower bracket of one of the other vertical panels of the system, an inner panel.

In a preferred embodiment, the system includes a base includes having one set of post apertures that open through the upper surface of the base generally adjacent to the upper base edge and an outer vertical panel having lower end post extensions, each extension of which is sized and shaped to be quickly and easily inserted into each post aperture so that the entire outer vertical panel is releasably secured to the upper surface of the base and the broad face of the panel is generally near or parallel to the upper edge of the base.

A related preferred embodiment includes a base having at least one set of post apertures—that open generally adjacent to one upper base edge and sized and shaped to receive the lower end post extensions from an outer vertical panel—, at least two sets of opposing base bracket slots—one set of which is positioned inward from the position of the post apertures and the other set of which is positioned inward from the opposing base edge position of the other of the post apertures—, an outer vertical panel that can be releasably secured to the base near the upper base edge through the receipt of lower end post extensions of the outer panel in the post apertures, and an inner vertical panel—sized and shaped and having a bracket extending from each opposing lower edge surface of the inner panel such that each panel can be releasably secured to and can form a vertical surface above the upper surface of the base when the brackets of the vertical panel are inserted into the base bracket slots. The inner panel may thereby be releasably secured to the base in a position relative to the outer panel such as generally perpendicular to the broad face of the outer vertical panel by receipt of the inner vertical panel brackets in the bracket slots to form, for example, a "T" or a "L"-like configuration. Sets of base bracket slots may open in alignment through the base face adjacent to at least two opposing upper base edges allows one or more inner panels to be secured generally at any position perpendicular or parallel to an outer panel. To further releasably secure an inner panel to an outer panel, the outer vertical panel of this embodiment may include a set of panel bracket slots opening through the upper edge of the outer panel that are sized and shaped to receive an upper bracket that extends from the upper edge of the inner vertical panel.

An additional embodiment of the present invention includes an inner panel that largely is not of the same vertical height as the outer panel or other inner panels and including a bracket arm from the end of which extends a bracket sized and shaped to be releasably secured in the panel bracket slots opening through the upper edge of the outer panel. The above embodiments may include additional components such as one or more additional inner panels that largely are not of the same horizontal length as the other inner panels and may include lower brackets that may be releasably secured to bracket slots within the base and an upper bracket that may be releasably secured to another vertical panel such as an outer panel by receipt of a portion of the upper bracket within panel bracket slots opening within the upper edge of the vertical panels. As a group, the vertical panels—that is, the outer panels and the inner panels—may be configured advantageously, for example, also such that an inner space is thereby defined in which a merchandise or other animate or inanimate objects may be housed, stored, or displayed. The system may include vertical panels having a shelving/storage construction that can accommodate display or shelving hardware such as shelves and/or bracket/shelf combinations or other horizontal support spaces easily and in a wide variety of positions thereby increasing the versatility of the system. Other components include one or more horizontal units that are easily attachable to the vertical panels to form shelves or other horizontal support spaces. The base may include wheels—such as swivel castor wheels placed generally at the four corners—to facilitate the movement of the base.

Overall, the components of the display system preferably have a construction so that the components and thereby the shelving/storage system may be relatively light in weight and easier to move as a result.

An object of the present invention is to provide a shelving/storage system that includes components that are sized and shaped and have a construction such that a wide variety of shelving and/or storage configurations may be easily and quickly arranged, thereby increasing the system's versatility.

An additional object of the present invention is to provide a shelving/storage system which includes a base having a construction such that one or more vertical panels may be quickly attached and detached and positioned at any of a number of positions relative to the base.

Another object of the present invention is to provide a shelving/storage system that includes a base and one or more vertical panels having a construction such that the vertical panel or panels may be releasably secured to the base without the need for known fasteners or tools and quickly even by the untrained or unskilled.

An added object of the present invention is to provide a shelving/storage system that includes vertical panels having different vertical heights and/or horizontal lengths and of a construction that allow the panels to be positioned in a number configurations such that a wide variety of shelving support spaces or storage spaces may be thereby defined.

These, together with other objects, features, and advantages will subsequently become apparent and reside in the details of the construction and operation as more fully hereinafter described, reference being had to the accompanying drawings, forming a part hereof, wherein like numerals refer to like part throughout.

DETAILED DESCRIPTION OF THE INVENTION

Figure 1:
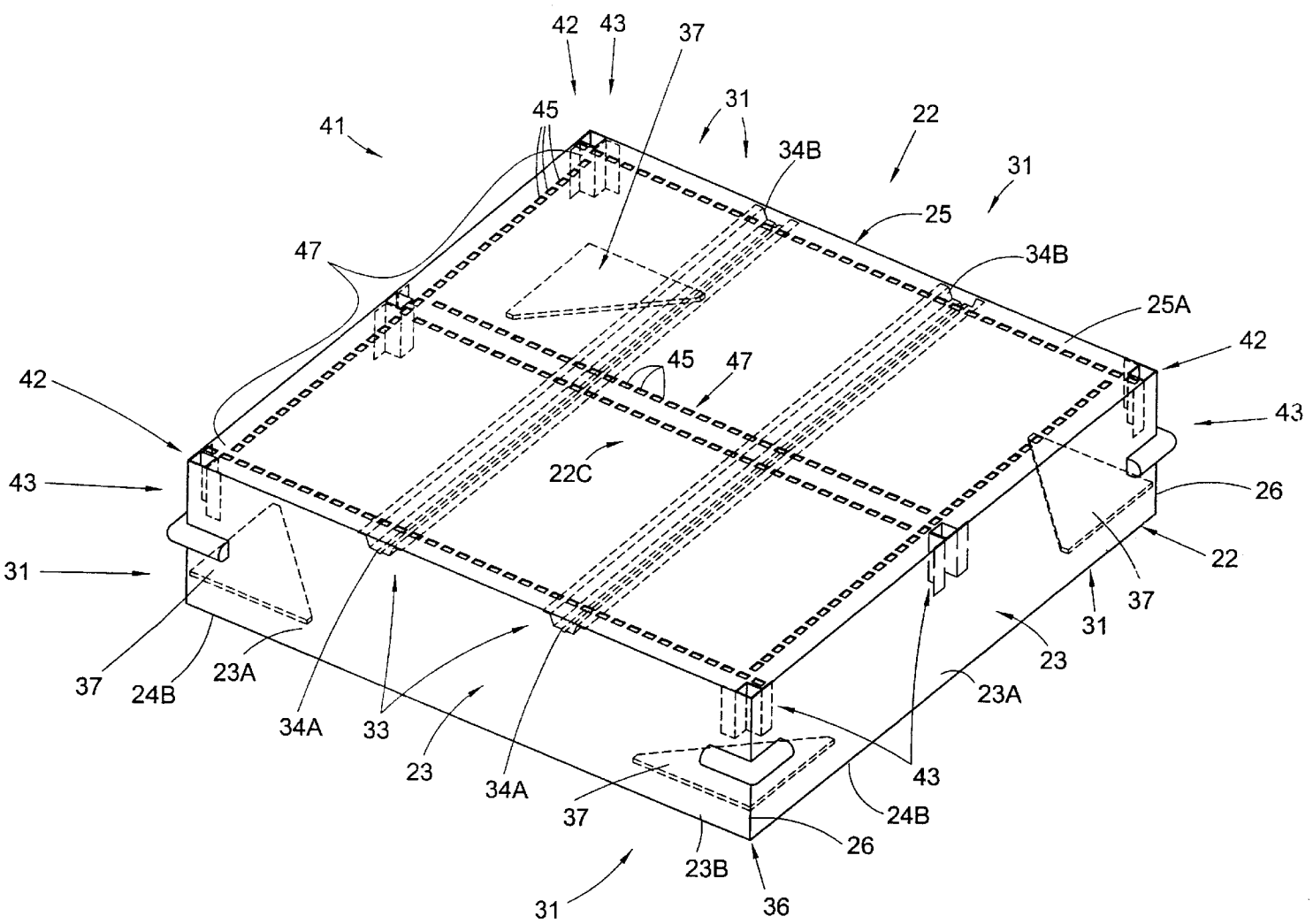
FIG. 1 is a perspective view of one embodiment of the base of the system according to the present invention showing certain principal components thereof.

A modular shelving/storage system according to the present invention is generally designated in the Figures by reference numeral 21. The system 21 is modular in that it is formable from a combination of one or more vertical panels 61 and a base 22, the base 22 having a construction such that a panel or panels 61 may be quickly and easily attached to the base without the need for screwdrivers, wrenches, pliers, or other such conventional tools and screws, bolts, nuts, or other such conventional mechanical attachment means. To further facilitate ease in configuring and reconfiguring the system 21 as needed and to keep the overall cost of manufacturing the system 21 down, the components of the system 21 are preferably of a simplified, lightweight construction. The base 22 will be described first.

Base 22 includes surrounding generally vertical base walls 23 and a dominant horizontally-aligned base wall 25. The juncture of the vertical base walls 23 and the horizontal base wall 25 forms an upper horizontal base edge 24. Preferably, the vertical base walls 23 and the horizontal base wall 25 are of a simplified monoplanar construction that may be formed by cutting and/or shaping a single sheet or sheets of metal and bending the sheet and joining—such as by welding—a plurality of sheet components together to form a base 22 such that the base 22 can adequately support and distribute the weight of items placed on it over a sufficient area and allow the one or more vertical panels 61 to be releasably secured to it in many configurations without tipping over. The preferred simplified construction of the base 22 advantageously also provides a generally open and uncluttered base undersurface space 22B that helps to keep the overall weight and cost of the base 22, and thereby the system 21 low and overall facilitates the use and maintenance of the system 21.

To further help maintain the structural integrity and shape of the base 22—even when a load is placed on it—yet not greatly increase the overall weight of the base 22, the base 22 may include one or more base supports 31. Preferred embodiments of the base supports 31 are those that can be carried below the surfaces 23A, 25A of the base 22 and/or are attached to or formed from the inner surfaces 23B and/or 25B such that the base undersurface remains generally open and free of clutter and light in weight. Such supports 31 are advantageous in that the upper surfaces 23A, 25A of the base remain also uncluttered and, as a result, the base 22, and overall the system 21 may be rapidly configured and reconfigured and the cleanliness and appearance of which may be easily maintained.

Figure 1A:
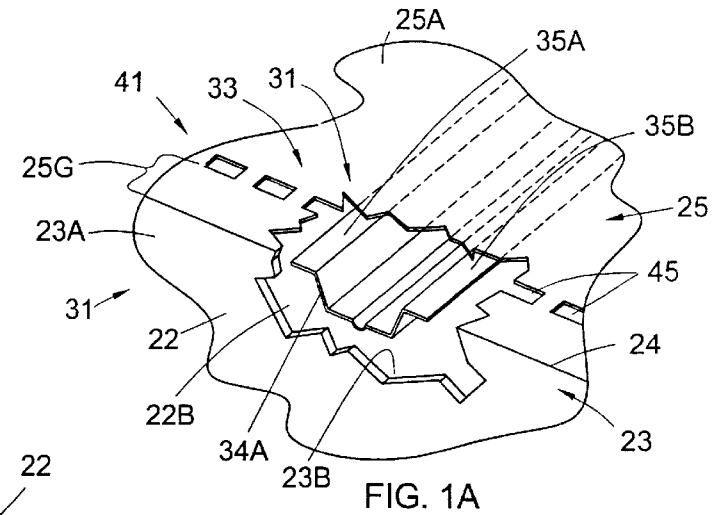
FIG. 1A is a detail of the base shown in FIG. 1 showing base bracket slots and partially in phantom a portion of a base support.
Figure 2:
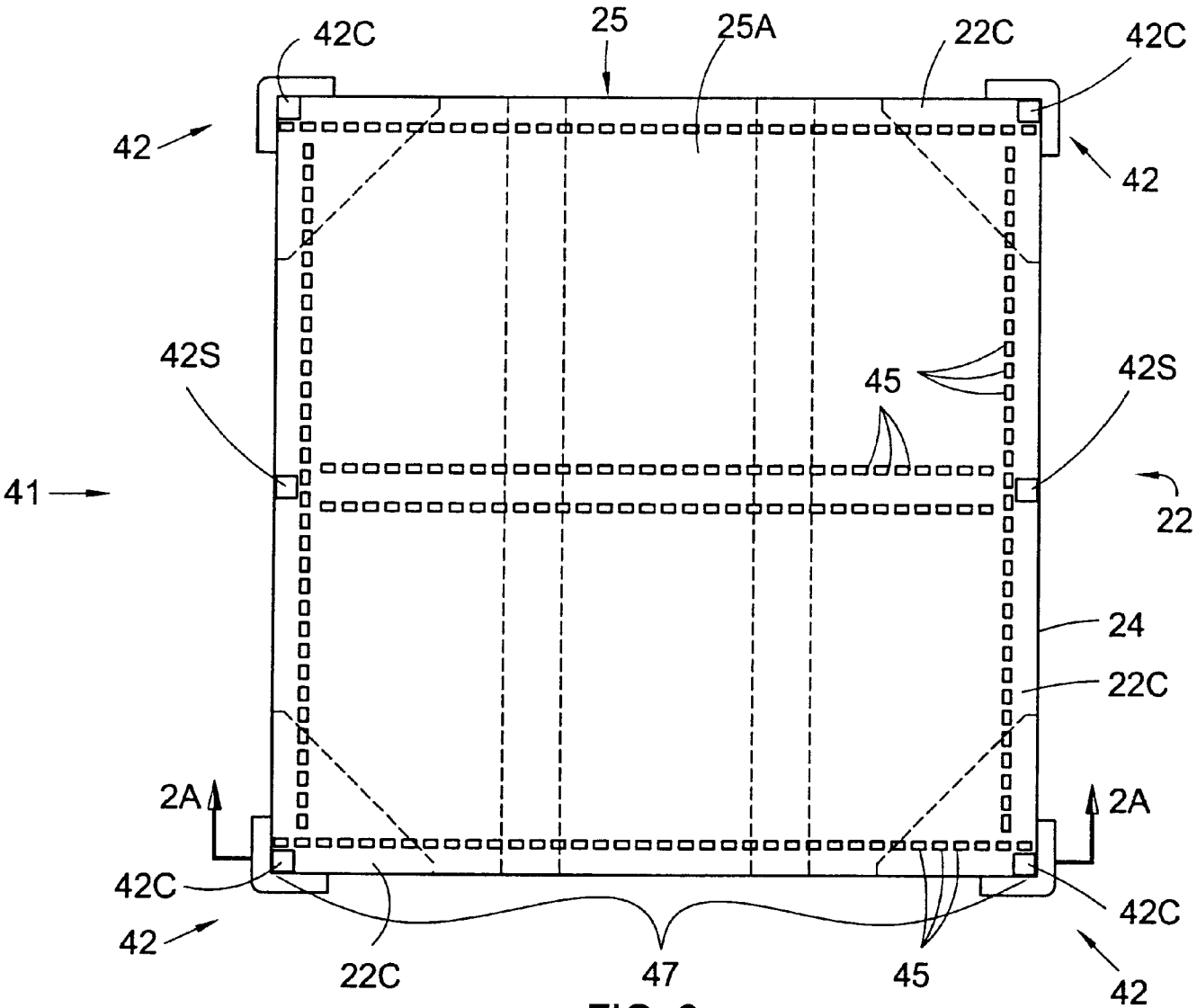
FIG. 2 is an overhead view of the base shown in FIG. 1 and further illustrating in phantom corner base supports fixed adjacent to the corner and linear base supports fixed to the upper wall inner surfaces of the base to provide additional lightweight support to the base.
Figure 2A:
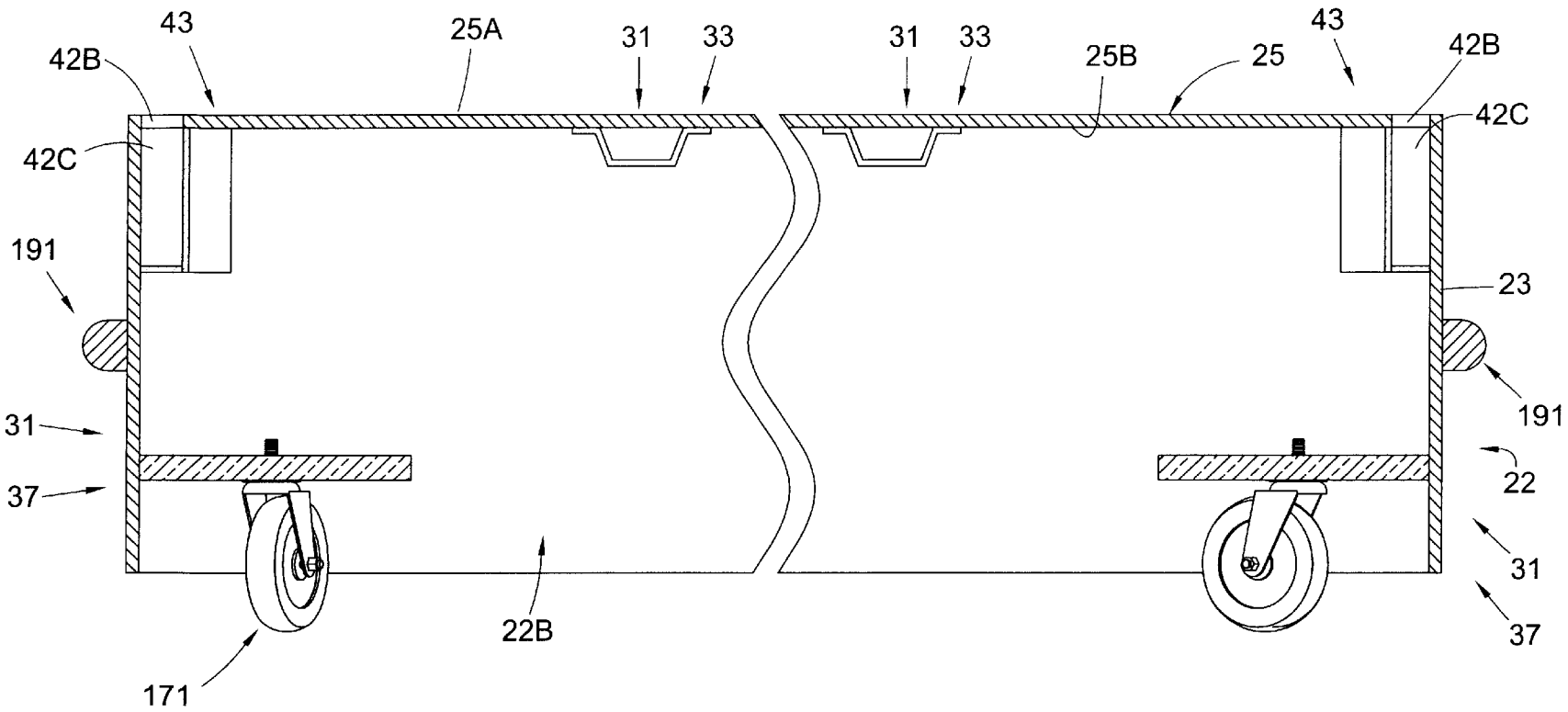
FIG. 2A is a cross sectional side view of the embodiment of the base shown in FIG. 1 and FIG. 2 showing the base supports and shaped aperture elements and the open base undersurface construction.

One preferred embodiment of the base support 31, a linear support 33, is of a size and shape such that the support 33 can be attached to and extend from one inner vertical wall surface 23B to another inner surface 23B and/or be attached to the inner horizontal wall surface 25B of the base 22. The embodiment of the linear support 33 illustrated in FIGS. 1, 1A, and 2A is aligned along a single general axis and includes opposing ends 34A, 34B—by which the linear support 33 may be fixed to the inner vertical base wall surfaces 23B—and flattened support strips 36A, 35B—by which the linear support 33 may be fixed, such as also by welding, to the inner horizontal base wall surface 25B. The embodiment of the base 22 illustrated in FIGS. 1, 1A, and 2A includes two linear supports 33, each of which is attached are their ends 34A, 34B to the inner surface 23B of the vertical walls 23 and by their support strips 35*a*, 35B to inner surface 25B of the horizontal base wall 25, such that linear supports 33 extend generally parallel to each other and adjacent to a mid-portion 22C of the base 22 in order to provide added strength to the base 22. While the linear support 33 may be formed according to a variety of methods, the embodiment of the linear support 33 illustrated in FIGS. 1, 1A, and 2A is formed by shaping—such as by bending—material—such as a thickened sheet of metal—to provide the illustrated widened U-shape. A linear support 33 formed in this way and having such construction is lightweight, yet strong. The linear supports 33 of the illustrated embodiment are attached to the base 22 after the base is largely formed and the apertures (discussed in greater detail below) are opened through the wall 25.

Another preferred embodiment of the support 31 that the system 21 may include to maintain the structural integrity and shape of the base 22 is a corner support 37. The corner support 37 is of a size and shape such that the support 37 can be attached to and extend from one inner vertical wall surface 23B to another inner surface 23B and/or be attached at and/or adjacent to the base inner corner edge 26B.

The embodiment of the corner support 37 illustrated in FIGS. 1 and 2A is of a monoplanar construction and triangular in shape and includes a surrounding edge wall 38 by a portion of which the corner support 37 is fixed to the inner vertical base wall surfaces 23B—such as by welding—and at and adjacent to the base inner corner edge 26B. The embodiment of the base 22 illustrated in FIGS. 1, 2, and 2A includes four corner supports 37, each of which is fixed—such as by welding the surrounding edge wall 38 to a lower portion of the inner surfaces 23B at and adjacent to the base inner corner edge 26B. Such support provides added strength to the base 22 at the corner edges 26—such as to help keep the base walls 23, 25 "square" and the edges 26 from being dented or buckling such as during movement of the base. While the corner support 37 may be formed according to a variety of methods, the embodiment of the linear support 37 illustrated in FIGS. 1, 1A, and 2A is formed by shaping—such as by cutting material—such as a thickened sheet of metal—to provide the illustrated triangular shape. A linear support 33 formed in this way and having such construction is lightweight, yet strong.

Base 22 includes a plurality of panel securement apertures 41 by which one or more vertical panels 61 may be releasably secured to the base 22 without the need for conventional separate mechanical fasteners or tools. Panel securement apertures 41 include post apertures 42, each of which is sized and shaped to provide an inner surface 42B that corresponds to the outer surface 115A of the lower portion 115 of a post 67 extending from a vertical panel 61 such that at least the lower portion 115 may be slidably inserted into and through the aperture 42. While each post aperture 42 is shaped to correspond to the shape of the outer surface 115A of the post 67 to be inserted therethrough and, accordingly, may be rectangular, circular, or any other suitable shape, the illustrated embodiments of the bases 22 include post apertures 42 having an inner surface 42B that is non-circular in shape. Such a shape corresponds to the shape of the outer surface 115A of the post extensions 115 of the illustrated embodiments of the vertical panels 61 and further advantageously prevents the post 67, and thereby the panel 61 to which the post is connected from twisting or torquing. Apertures 42 may be formed in the base 22 according to a number of methods—such as cutting or punching through the thickened sheet of metal from which the base horizontal wall 25 is formed—and are spaced apart according to the spacing of the corresponding post extensions 115.

Additional panel securement apertures 41 that the base 22 may include and that facilitate the securement of one or more vertical panels 61 to the base 22 without conventional mechanical fasteners or tools include one or more base slots 45. Each base slot 45 is sized and shaped to correspond to the outer surface 121A of a portion of or largely the entire lower bracket 121 (discussed in greater detail below) extending from a vertical panel 61 such that at least the corresponding portion of the outer surface 121A of the bracket 121 may be slidably inserted into and through and releasably secured to the slot 45. While each slot 45 is shaped to correspond to the size and shape of the outer surface 121A of the lower bracket 121 to be inserted therethrough and, accordingly, may be rectangular, circular, or any other suitable shape, embodiments of the base slots 45 that are non-circular in shape also prevent the twisting or torquing of the brackets 121 and the panel or panels 61 from which the brackets extend. The illustrated base slots 45 are rectangular in cross section and have an inner surface 45B that is sized to provide a depth (not shown) that is sufficient to receive and releasably secure a lower slot engaging component 123 of the base bracket 121 without the need for a complex housing such as a rail or other structure. As with the post apertures 42, the base slots 45 may be formed in the base 22 according to a number of methods—such as cutting or punching through the thickened sheet of metal from which the base horizontal wall 25 is formed—and are spaced apart according to the spacing of the corresponding brackets 121.

Figure 1B:
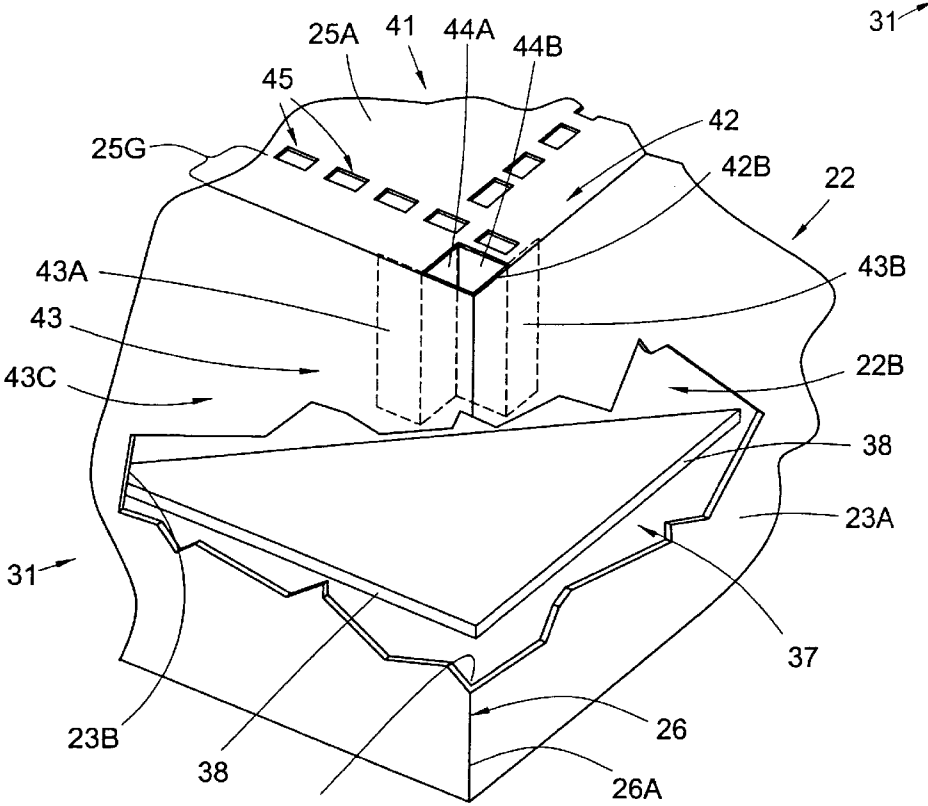
FIG. 1B is a detail of the base shown in FIG. 1 showing a base support and also a post aperture adjacent to which a shaped aperture element is attached to the inner surface of the vertical wall of the base.
Figure 1C:
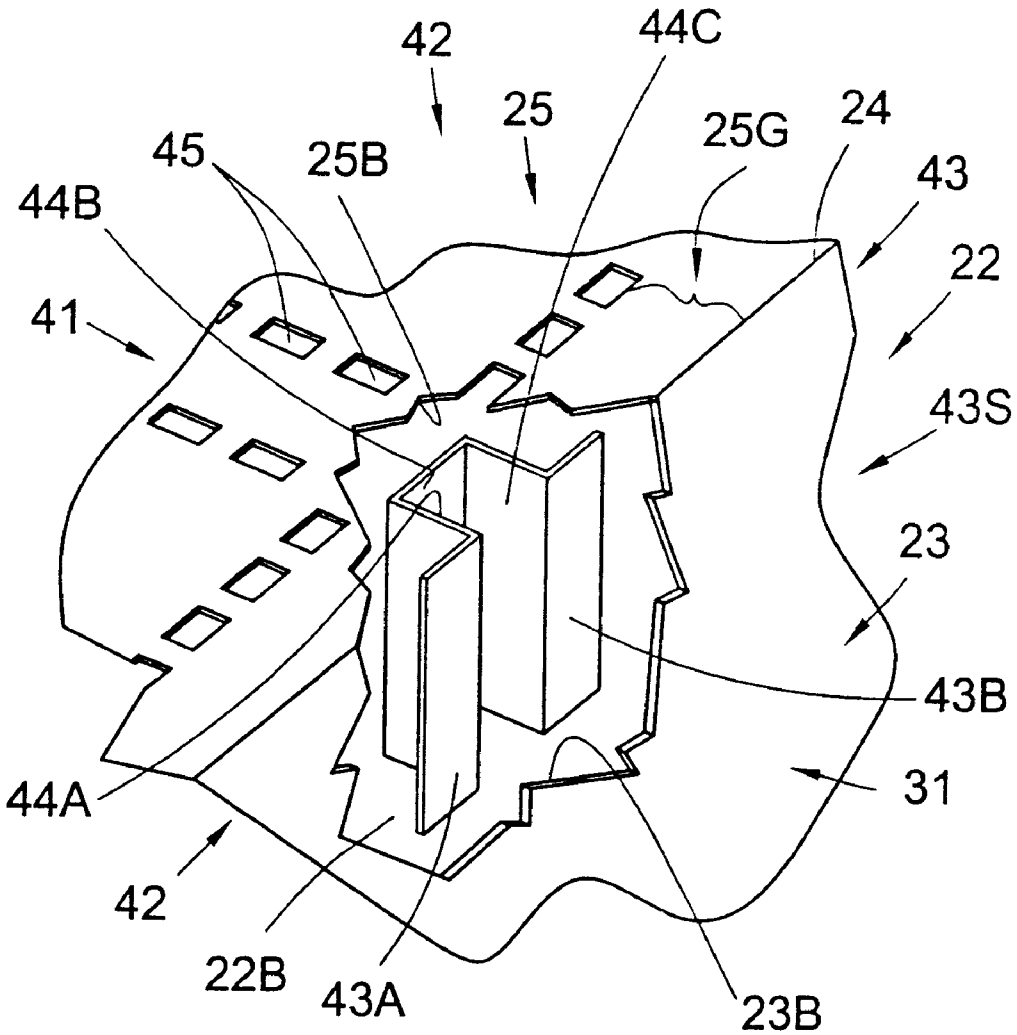
FIG. 1C is a detail of the base shown in FIG. 1 showing also a post aperture that opens through the upper surface of the base adjacent to the edge of the base along one of its walls and adjacent to which a shaped aperture element is attached to the inner vertical wall surface.

Base 22 may include shaped aperture elements 43 to facilitate the releasable securement and support of one or more vertical panels 61 to the base 22 without the need for conventional separate mechanical fasteners or tools. Shaped aperture elements 43 may very in size and shape according to the position of the aperture 41 through the base wall 25. One embodiment of the element 43 is illustrated in FIGS. 1 and 1B. The element 43C is shaped to be received adjacent to a corner post aperture 42C the inner corner edge 26B of the base 22 and in those embodiments having such component, above the corner support 37. The illustrated embodiment of the element 43C is shaped further to provide two attachment faces 43A, 43B—by which the element may be attached to the inner faces 23B of the base 22—and two support faces 44A, 44B—which in combination with the inner faces 23B of the base wall 23, can facilitate the support of the lower portion 115 of a post 67 extending from a vertical panel 61 by the slidable insertion of at least the lower portion 115 of the post 67 into and through the aperture 42C positioned adjacent to the base corner 26. Another embodiment of the element 43 is illustrated in FIGS. 1 and 1C. The element 43S is shaped to facilitate the support of a post extension 115 in an aperture 42S opening through the base 22 away from the inner corner edge 26B. The illustrated embodiment of the element 43S is U-shaped and includes two attachment faces 43A, 43B—by which the element may be attached to the inner faces 23B of the base 22—and three support faces 44A, 44B, 44C—which in combination with the inner face 23B of the base wall 23, can facilitate the support of the lower portion 115 of a post 67 extending from a vertical panel 61 by the slidable insertion of at least the lower portion 115 of the post 67 into and through the aperture 42S. Each element 43 is preferably shaped to correspond to the shape of the outer surface 115A of the post 67 to be inserted through the aperture 42 and, accordingly, maybe rectangular, circular, or any other suitable shape. The illustrated embodiments of the elements 43 have non-circular faces to further prevent the twisting or torquing of the post 67 and panel 61. Elements 43 may be formed according to a number of methods—such as cutting and shaping, such as through bending, thickened sheet metal to provide an element 43 of the desired shape.

The system 21 includes at least one vertical panel 61. Additional embodiments of the system 21 may include one or more additional outer panels 71 and/or one or more inner panels 81. Each vertical panel 61 of the system 21 includes opposing broad faces 62, an upper edge 63, lower edge 65, side edges 66, and panel securement means 111 by which each panel 61 is releasably engageable to the base 22 quickly and easily and without the need for tools and screws, bolts, nuts, or other conventional mechanical attachment means such that the panel or panels 61 can form generally a vertical surface above the base wall 25.

The embodiments of the vertical panels 61 illustrated in the Figures include a lintel 64 that generally defines the upper edge 63 and posts 67 on either side that generally define the side edges 66 of the vertical panels 61. The lintel includes ends 64A, 64B by which the lintel 64 is fixed—such as by welding—to the two vertical posts 67. The lintel 64, as well the posts 67 may be formed from a variety of constructions. Advantageously, a lintel 64 and posts 67 having a tubular construction allow the overall weight and manufacturing cost of each panel 61 and thereby the entire system to be kept low without greatly reducing the weight bearing capacity of the panels 61. Secured to and extending between the lintel 64 and the posts 67, the panels 61 may include a variety of shelving/storage constructions 62A by which the shelving, display, and/or storage of merchandise or other animate or inanimate objects are facilitated. Such shelving/storage constructions 62A include a slatwall construction—such as that made from wood, a laminate, metal such as aluminum, or plastic—, a grid or grill pattern, or other decorative or functional structure by which other components may be easily and quickly attached to the panel 61 or on or by which other components may be displayed.

The preferred panel securement means 111 are those that allow each panel 61 to be releasably secured to the base 22 through the slidable insertion of a portion of the means 111 into the panel securement apertures 41. The means 111 by which the outer panel 71 is releasably securable to the base 22 in the illustrated embodiments is preferably different from the means 111 by which the inner panel 81 is releasably securable to the base 22.

The illustrated embodiments of the outer panel 71 is sized and shaped to extend generally across and perpendicular to the base upper surface 25A such that, when the panel 71 is releasably secured to the base 22, panel side surface 66A of one edge 66 of the panel 71 is generally vertically flush with one edge 24 of the base and the panel side surface 66A of an opposing edge 66 of the panel 71 is generally flush with the opposing edge 24 of the base 22. The panel securement means 111 of each outer vertical panel 71 facilitates such attachment. The panel securement means 111 of each outer vertical panel 71 includes a post extension 115 that projects from each of the lower edge corners 65C of the panel 71. In the illustrated embodiments of the outer panels 71, each post extension 115 is an integral vertical extension of the posts 67 below the lower edge 65 of the base. Each post extension 115 includes a extension surface 115A sized and shaped to correspond to the inner surface 42B of the post aperture 42 such that the extension 115 may be slidably inserted in and thereby is releasably engageable with a post aperture 42 opening through the surface 25A of the base 22. While each post 67 may be of a variety of shapes, the extension 115 of such post 67 is preferably non-circular in shape so that advantageously the post, and thereby the panel 71 to which the post is connected cannot easily twist or torque. With the post extensions 115 of a outer vertical panel 71 inserted in post apertures 42 that are positioned generally adjacent to the base edges 24, the outer panel 71 extends across the base surface 25A from base edge 24 to an opposing base edge 24.

Figure 5:
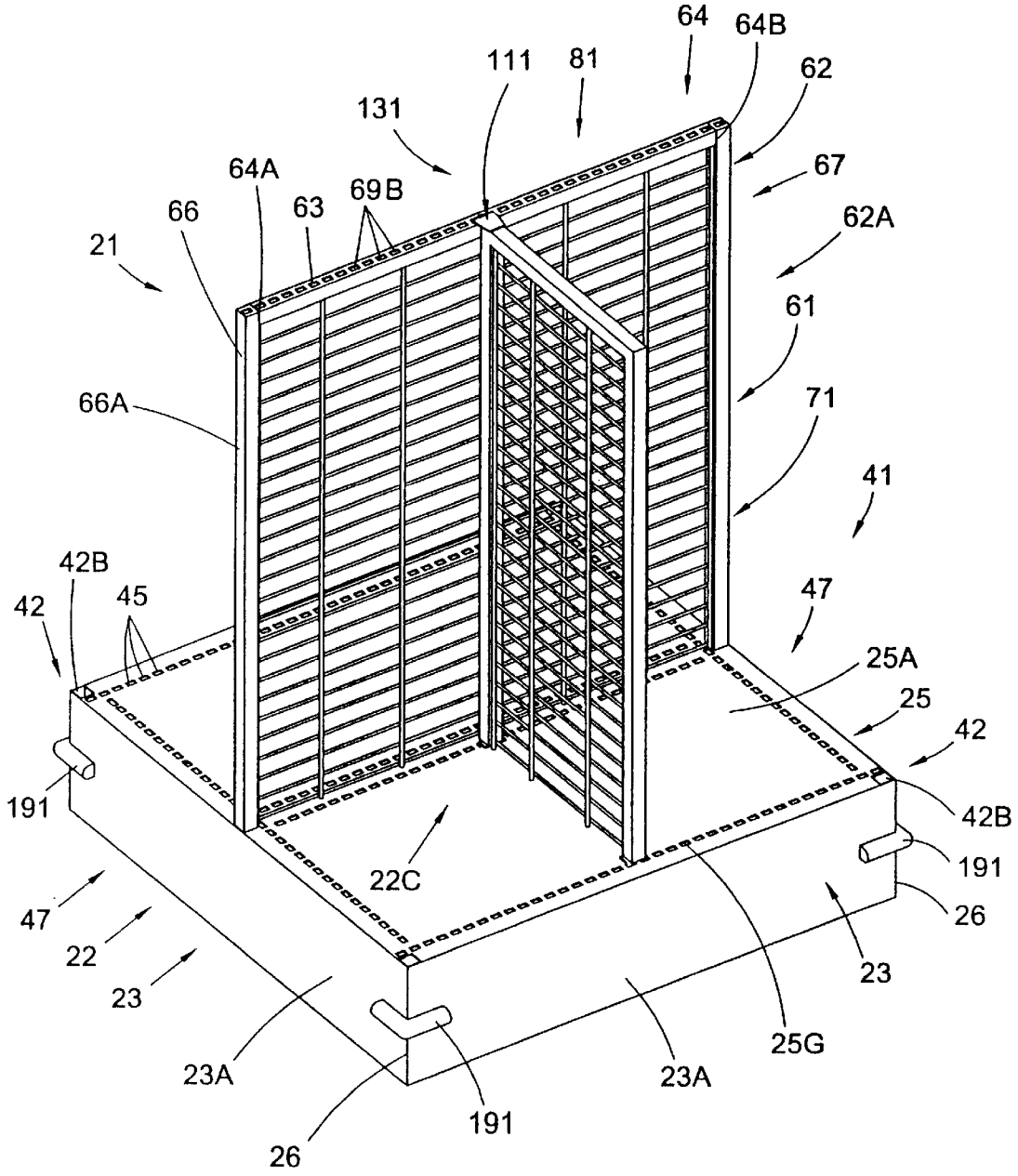
FIG. 5 is a perspective view of another embodiment of the present invention including two opposing sets of base bracket slots and sets of post apertures, an outer panel releasably secured near the center of the upper surface of the base, and a partial inner panel secured by receipt of its lower brackets into the base slots and an upper bracket into a upper edge bracket slots of the outer panel to form a "T" configuration.

In addition to additional one or more outer panels 71, the system 21 may include one or more inner vertical panels 81. The illustrated embodiments of the inner panel 81 are preferably sized and shaped to extend generally across much of the surface 25A such that, when the panel 81 is releasably secured to the base 22, the edges 66 of the panel 81 are spaced away and generally inward from the edges 24 of the base 22 to provide a gap 25G. Embodiments of the system 21 may include vertical panels 61 that may extend across only a partial portion of the surface 25A such that at least one of the edges 66 of the panel 81 is at a greater distance from the base edge 24 than 25G. FIG. 5 shows an inner panel 81 having a size such that one side edge 66 of the panel 81 may be positioned generally adjacent to the base edge 24 and the opposing side edge 66 is positioned generally adjacent to the midway portion 22C of the base. The panel securement means 111 by which each inner vertical panel 81 may be attached to the base 22 includes a lower bracket 121 projecting from a lower end 68 of each of the opposing vertical posts 67 of the inner panel 81. The lower bracket 121 may be formed, for example, such as by cutting or otherwise shaping material so that at least one portion of the bracket 121 is sized and has a surface 121A shaped to be received in and thereby releasably secured to one or more slots 45 in the base 22. The illustrated embodiment of the inner panel 81 includes lower brackets each of which may be formed by cutting thickened sheet metal to provide a blank having separate lower slot engaging components 123. The blank is bent and attached—such as by welding—to the lower end 68 of the post 67 so that the lower slot engaging components 123 are generally parallel to and flush with the edge 66 of the panel 81. While each engaging component 123 of each bracket 121 has a surface 123A is shaped generally to correspond to the size and shape of the inner surface 45B of the slots 45 and, accordingly, may be rectangular, circular, or any other suitable shape, the illustrated embodiments of the engaging components 123 have a rectangular shaped outer surface 123A. An engaging component 123 of such a non-circular shape received in a post aperture 45 having a corresponding size and shape advantageously generally prevents the twisting or torquing of the brackets 121 and the panel 81 from which the bracket 121 extends.

Figure 5B:
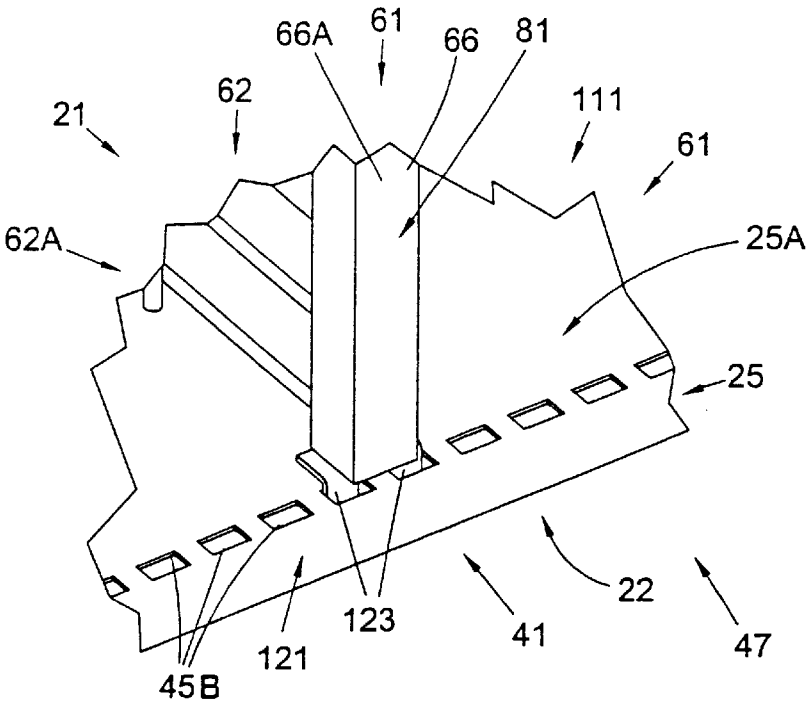
FIG. 5B is a detail of the embodiment shown in FIG. 5 and showing the receipt of engaging components of the lower base bracket of the inner panel into base bracket slots.
Figure 6:
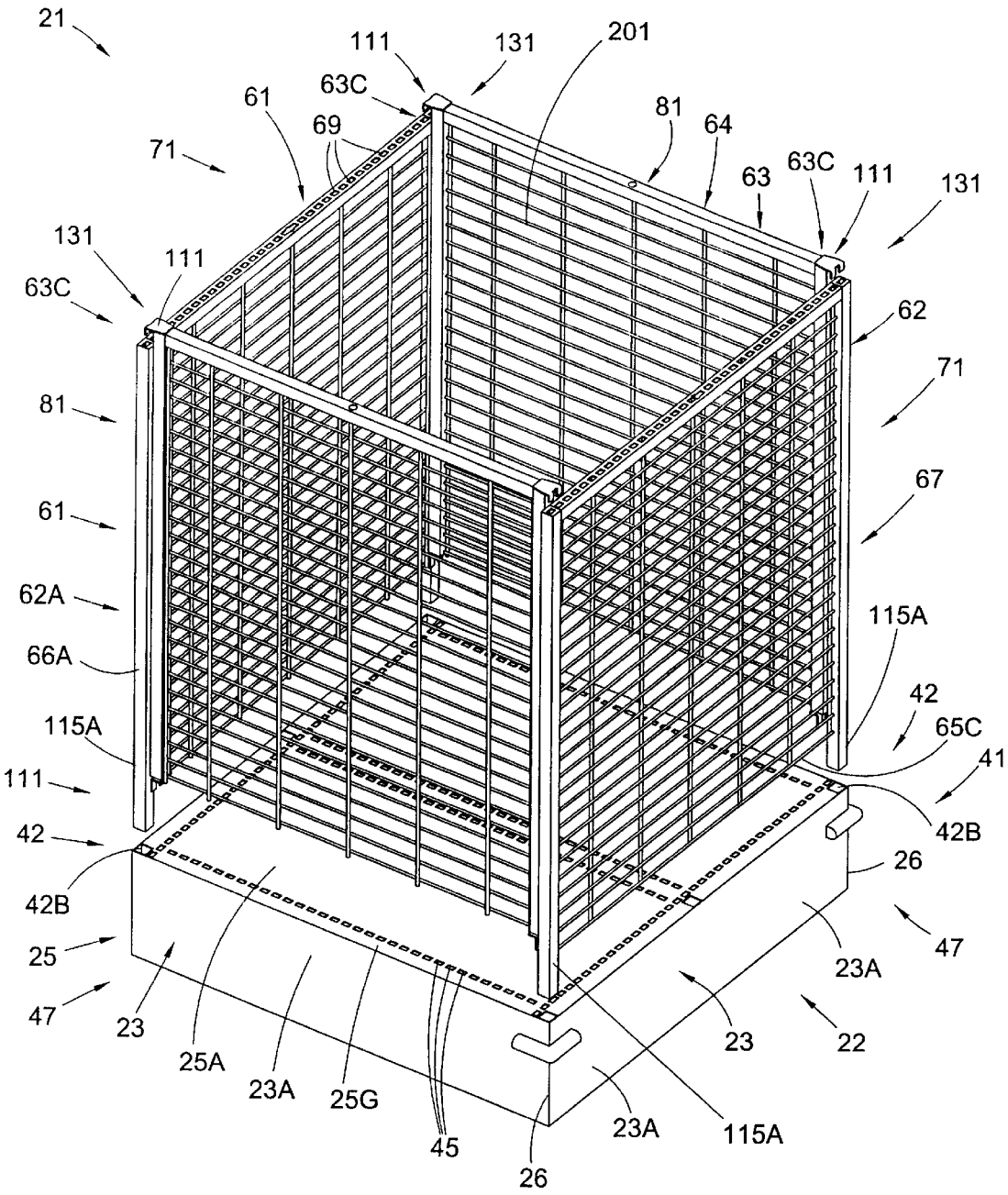
FIG. 6 is a perspective view of another embodiment of the present invention including opposing sets of base bracket slots and sets of post apertures positioned adjacent to the corners of the base, two outer panels each of which is releasably secured near opposing edges of the upper surface of the base, and two inner panels each of which is secured by receipt of the engaging components of the base brackets into the base slots and of their upper brackets into upper edge bracket slots of the outer panels to form an inner space configuration.
Figure 6B:
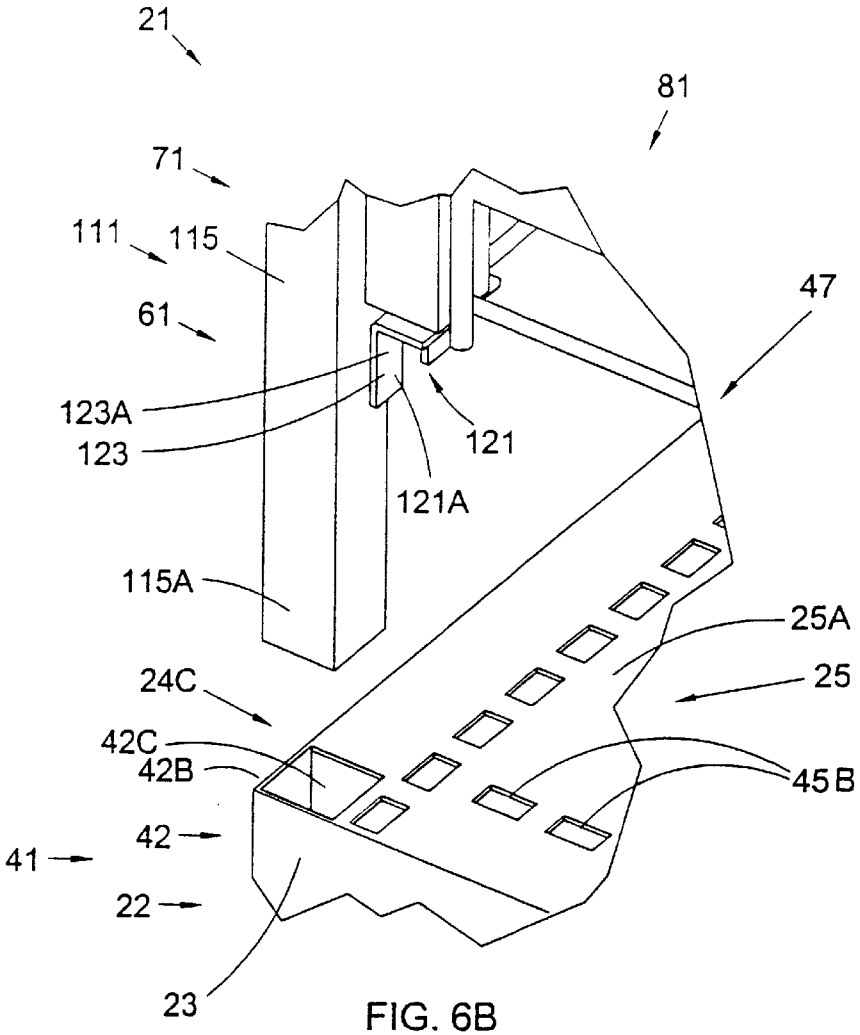
FIG. 6B is a detail of the embodiment shown in FIG. 6 in which an inner panel is positioned generally flush with and perpendicular to an outer panel and showing the lower bracket of an inner panel positioned over and for receipt in the base bracket slots and the extension of the post of the outer panel positioned over a post aperture for releasable securement therein.

The inner panel 81 shown in the illustrated embodiments of the system 21 includes is sized and shaped such that, when the bracket components 123 of the panel 81 are inserted into the base bracket slots 45, a gap 25G forms between the side edges 66 of the panel 81 and the base edge 24 that is generally sufficient in size to accommodate the edge width of the outer panel 71 and to permit the post extensions 115 to be inserted into the base apertures 42 opening through the upper surface 25 of the base 22 within the same gap 25G. FIG. 5B is a detail of the embodiment shown in FIG. 5 illustrating the lower bracket 121 of an inner panel 81 positioned over and for receipt of the bracket component 123 in the base bracket slots 45 generally away from the corner 24C. FIG. 6B is a detail of the embodiment shown in FIG. 6 illustrating the lower bracket 121 of an inner panel 81 positioned over and for receipt of the bracket component 123 in the base bracket slots 45 generally adjacent to the corner 24C and flush with a post 67 of an outer panel 71.

Figure 5A:
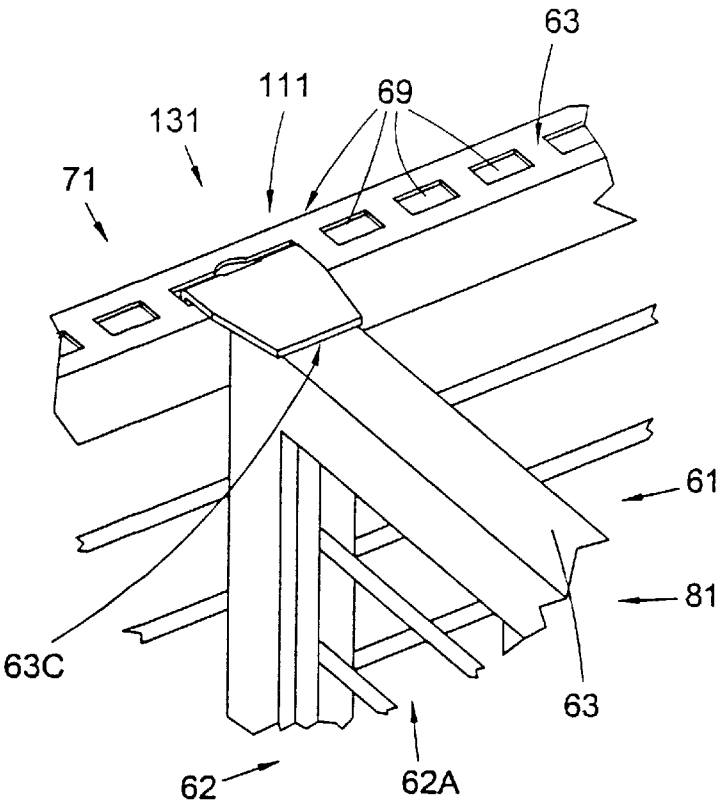
FIG. 5A is a detail of the embodiment shown in FIG. 5 and showing the receipt of an upper bracket extending from the partial inner panel and whose engaging components are inserted into upper edge bracket slots in the outer panel.
Figure 6A:
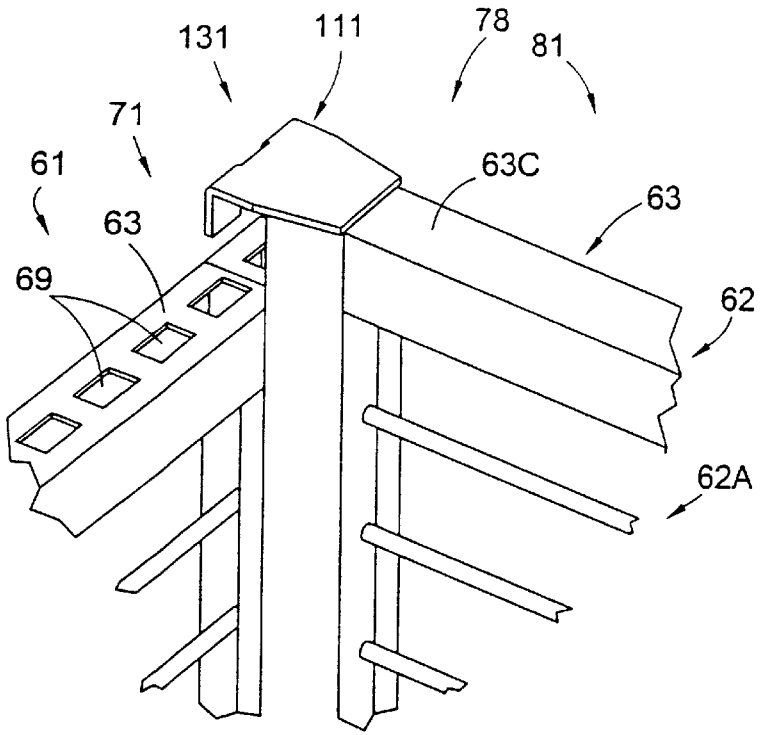
FIG. 6A is a detail of the embodiment shown in FIG. 6 and showing the engaging components of the upper bracket of an inner panel positioned over and for receipt in the upper bracket slots of an outer panel.

The system 21 may include additional panel securement means 111 that allow each panel 61 to be releasably secured to each other. The additional panel securement means 111 includes an upper bracket 131 extending from an upper edge 63 of the inner panel 81 and sized and shaped such that the inner panel 81 may be releasably secured to another panel 61 by such bracket 131. The illustrated embodiments of the inner panels 81 includes an upper bracket 131 affixed—such as by welding—to and projecting from one or both of the upper edge corners 63C of the inner panel 81. For embodiments of the inner panels 81 that are not of the same vertical height as the panel 61 to which it is to be releasably secured—such as one of the inner panels 81 shown in the FIG. 7 system configuration—, the upper bracket 131 may be affixed to the upper edge corner 63C of a generally vertical arm 138—such as that formed by a vertical extension of the post 67. The upper bracket 131 is sized and shaped to be releasably secured in upper bracket slots 69 opening through the upper edge 63 of the outer panel 61. FIG. 5A illustrates a detail of the embodiment shown in FIG. 5, particularly the upper bracket 131 of an inner panel 81 positioned over and for receipt in the upper bracket slots 69 opening along the upper edge 63 and away from the upper corner 63C of the outer panel 71. FIG. 6A illustrates a detail of the embodiment shown in FIG. 6, particularly the upper bracket 131 of an inner panel 81 positioned over and for receipt in the upper bracket slots 69 opening along the upper edge 63 and at and adjacent to the upper corner 63C of the outer panel 71.

The upper bracket 131 may be formed may be formed, for example, such as by cutting or otherwise shaping material so that at least one portion of the bracket 131 is sized and shaped to be received in and thereby releasably secured to corresponding one or more panel slots 69 that may open through the upper edge 63 of the outer panel 71. The illustrated embodiments of the inner panels 81 includes one or more upper brackets 131 each of which may be formed by cutting thickened sheet metal to provide a blank having separate panel slot engaging components 133. The blank is bent and fixed—such as by welding—to one or both of the upper edge corners 63C of the panel 81 so that the upper slot engaging components 133 are generally parallel to but extend outward from the edge 66 of the panel 81 a sufficient distance to permit the edge 66 of the inner panel 81 to be generally flush with the face or faces 62 of the outer panel or panels 71 to which the panel 81 is releasably secured. While each engaging component 133 is shaped generally to correspond to the size and shape of the inner surface 69B of the upper slots 69 and, accordingly, may be rectangular, circular, or any other suitable shape, the illustrated embodiments of the engaging components 133 have a rectangular shape. An engaging component 133 of such a non-circular shape received in a slot or slots 69 having a corresponding size and shape advantageously generally prevents the twisting or torquing of the brackets 133 and the panel 81 from which the bracket 133 extends. Embodiments of the system 21 that include one or more outer panels 71 with upper edge slots 69 and one or more inner panels with upper brackets 131 advantageously allow the outer panels 71 and the inner panels 81 to be configured and reconfigured easily and quickly into a variety of patterns such as an "L"-like pattern, a "T"-like pattern, a "H"-like pattern, or variants of these.

The system may include other components—such as one or more horizontal display units 151—that are easily attachable to the vertical panels 61 to form shelves or other horizontal support spaces. Because of the simplified, lightweight construction of the system 21 and open, uncluttered undersurface space 22B, the system can rest on the surrounding lower edge 24B of the base and be moved about even in a fully assembled condition. To facilitate such movement, the base 22 may include caster wheels 171 that are attachable to the base such as by fixation to the corner supports 37. One or more bumpers 191 may be fixed at and adjacent to the edges 26 to reduce the likelihood that the base 22 may cause damage or be damaged such as while it is being moved. The system 21 may include point-of-sale assemblies or the means to carry such assemblies—such as oen or more apertures in the panels 61 (not shown) in which one or more vertical sign holders and signs may be inserted.

Numerous multi-sided configurations can be constructed from the system 21 components quickly and easily without any tools or fasteners—conventional or specialized—depending on the merchandising or display requirements of the retailer or other and depending on the type of merchandise that will be stored on or in the system. The system 21 may be used to stock and display and/or store a variety of items including variable sized packages, other types of inanimate objects, and in certain configurations animate objects such as animals at a pet store.

Figure 3:
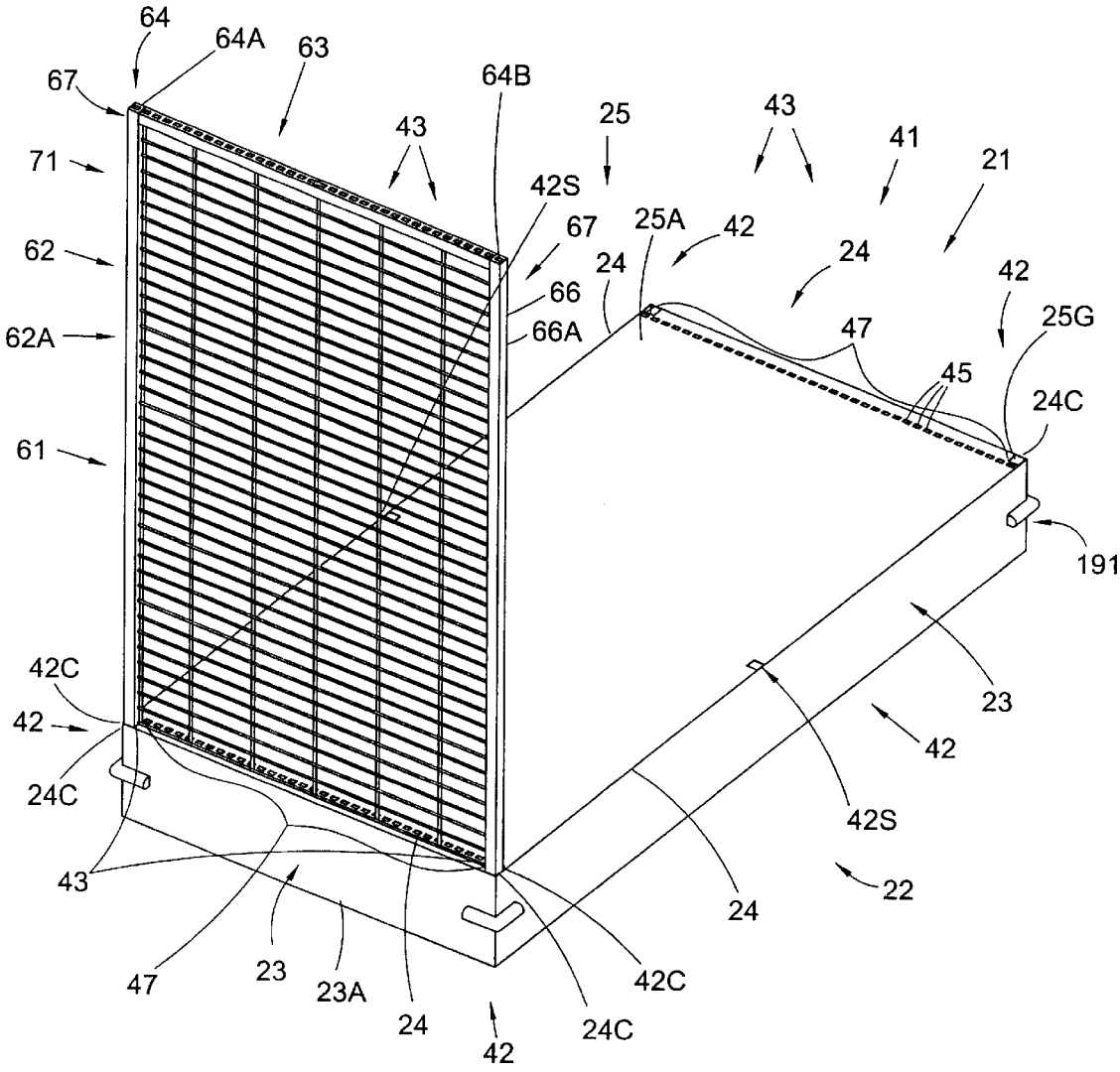
FIG. 3 is a perspective view of a preferred embodiment of the system according to the present invention and including a base having sets of post apertures and opposing sets of base bracket slots and an outer panel having posts that include end extensions sized and shaped to be received in a set of the post apertures such that the outer panel may be releasably secured to the upper surface of the base.

One such configuration of the system is illustrated in FIG. 3 and includes a rectangular-shaped base 22 and an outer panel 71. The outer panel 71 includes a lintel 64—that generally defines the upper edge 63; opposing posts 67—that generally define the side edges 66 of the vertical panels 61; and a grill like shelving storage construction 62A extending between the lintel and posts. The illustrated base 22 includes panel securement apertures 41 for releasable attachment of the outer panel 71 and other vertical panels 61 to the base. The base 22 includes post apertures 42—sets 43 of which open through the base 22 and generally adjacent to opposing upper corners 24C of the upper base edge 24 and another set 43 of which is positioned adjacent to a point generally midway along opposing edges 24—and two sets 47 of base slots 45, each set of which is linearly aligned adjacent to each of two opposing upper edges 24, but inward from a set 43 of post apertures 42 to form gap 25G.

The outer panel 71 is releasably secured to the upper surface 25 of the base 22 by the receipt of lower portions 115 of the panel posts 67 in the post apertures 42 such that one broad face 62 of the panel is generally flush with one of the side wall faces 23A of the base and the panel edges 66 are generally flush with opposing side wall faces 23A of the base. The additional panel securement apertures allows one or two additional outer panels 71 and one or more inner panels 81 to be releasably secured to the base 22. Advantageously, the embodiment of the outer panel 71 forming one component of the FIG. 3 system configuration includes opposing broad faces 62 having a shelving/storage construction 62A—the shown open grill work that forms the largest portion of the broad faces 62 of the panels 61—that allows merchandise to displayed from the vertical panels in two dominant directions. The open grill work shelving/storage construction 62 of the illustrated embodiments of the vertical panels 61 allows a variety of other components such as the horizontal support units 151 to be affixed to and thereby supported from the construction while furthering the goal of providing an overall light weight and sturdy system. The system 21 as configured in FIG. 3 provides also an open uncluttered upper surface 25A of the horizontal base wall 25 such that additional merchandise may be carried on it or on which other displays, for example, a mannequin or smaller shelving systems or promotional items, may be supported.

Figure 4:
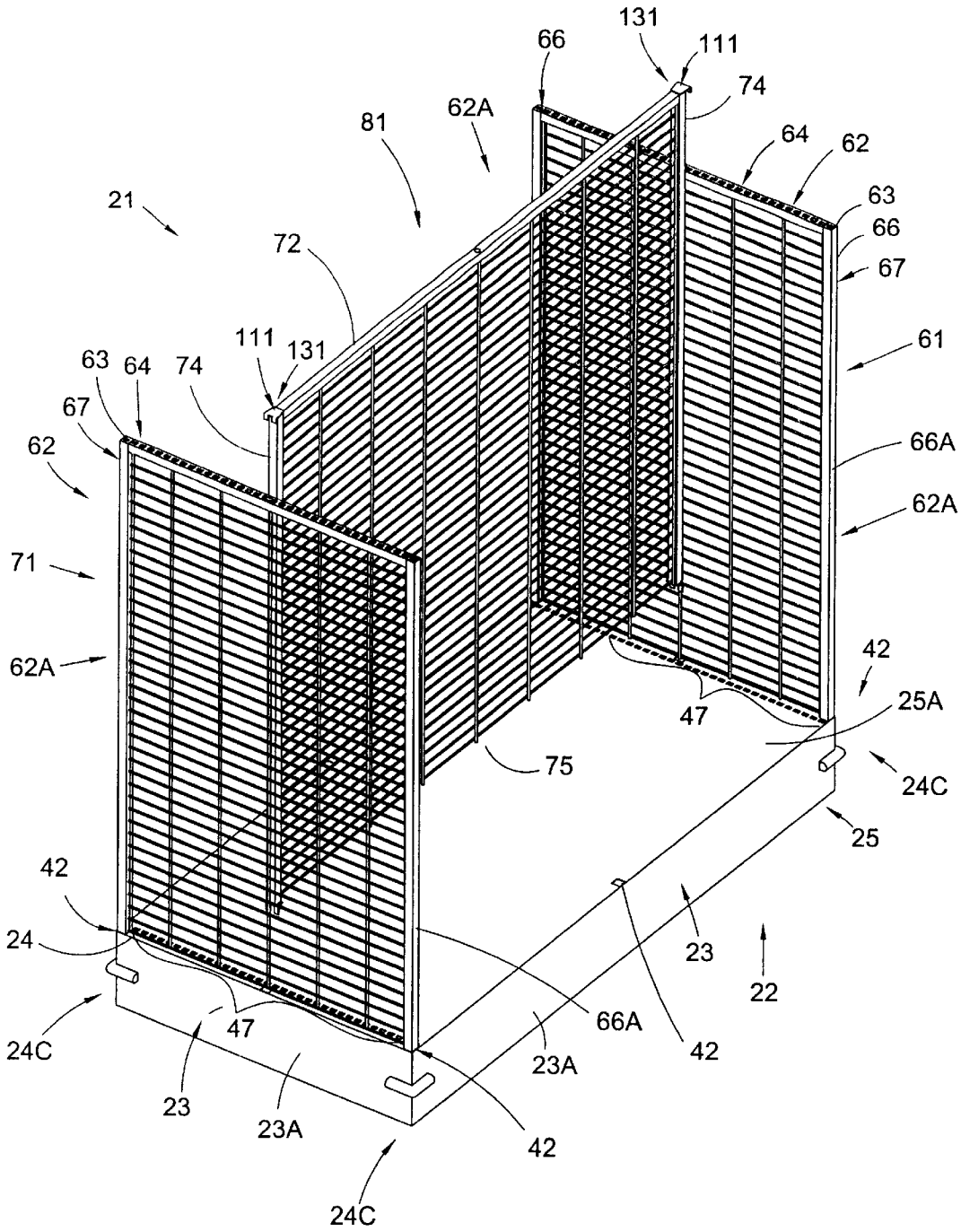
FIG. 4 is a perspective view of an additional embodiment of the present invention including a base having one opposing set of base bracket slots and sets of post apertures, two outer panels, each of which is releasably secured near opposing upper edges of the base, and an inner panel secured by receipt of its base brackets into the base slots and its upper brackets received into upper edge bracket slots of each of the outer panels to form a broadened "H" configuration.
Figure 7:
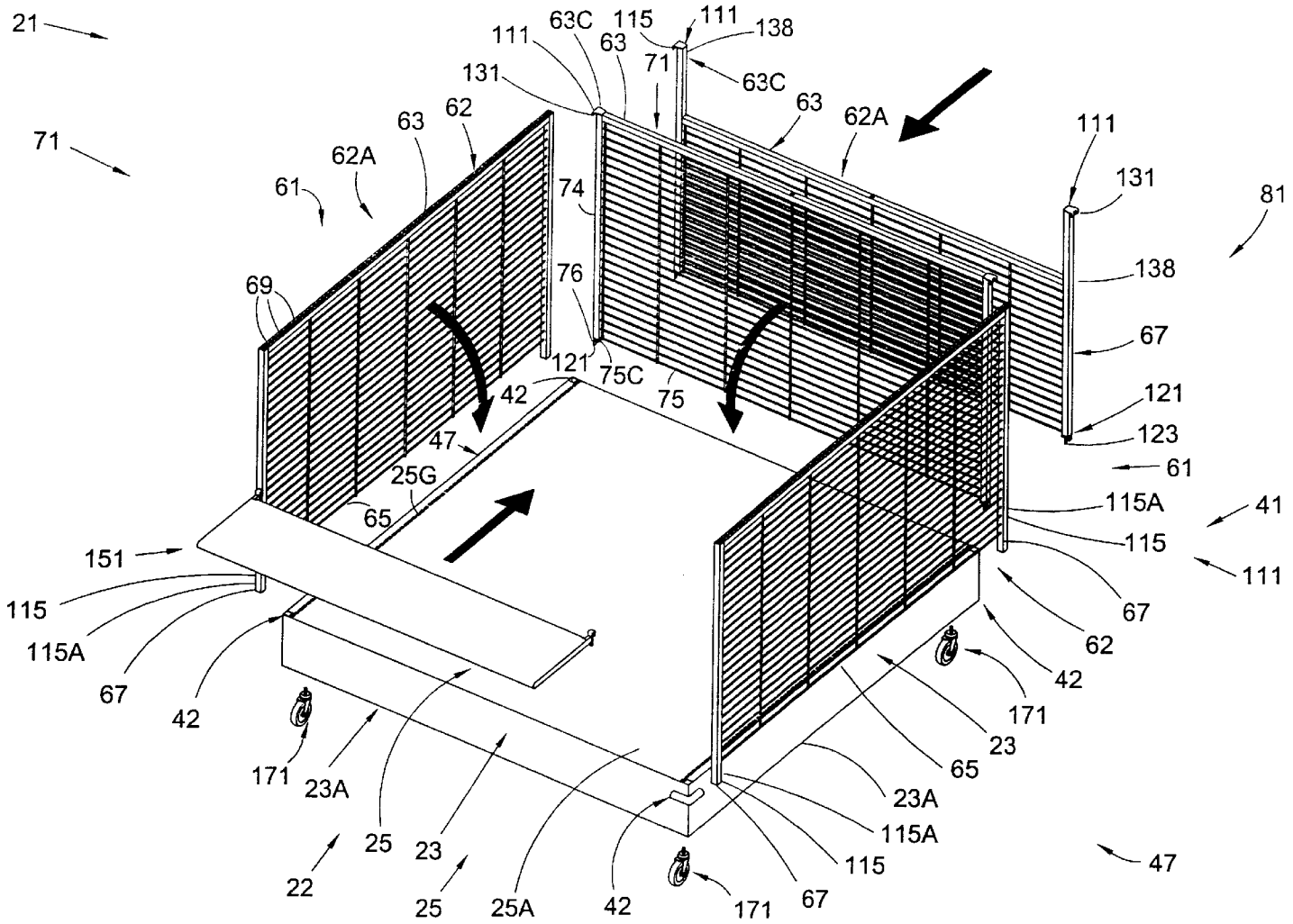
FIG. 7 is an exploded perspective view of an embodiment of the present invention including a base—having one opposing set of base bracket slots, sets of post apertures adjacent to each corner of the base, and caster wheels for receipt in the lower portion of the base—, two outer panels, inner panels—one of which is of a shortened vertical height and including bracket arms at the end of each of which is a bracket that can be releasably secured to the outer panel by receipt of the upper bracket into the upper edge slots—, and a shelf that can be secured to the broad face of one of the vertical panels.
Figure 8B:
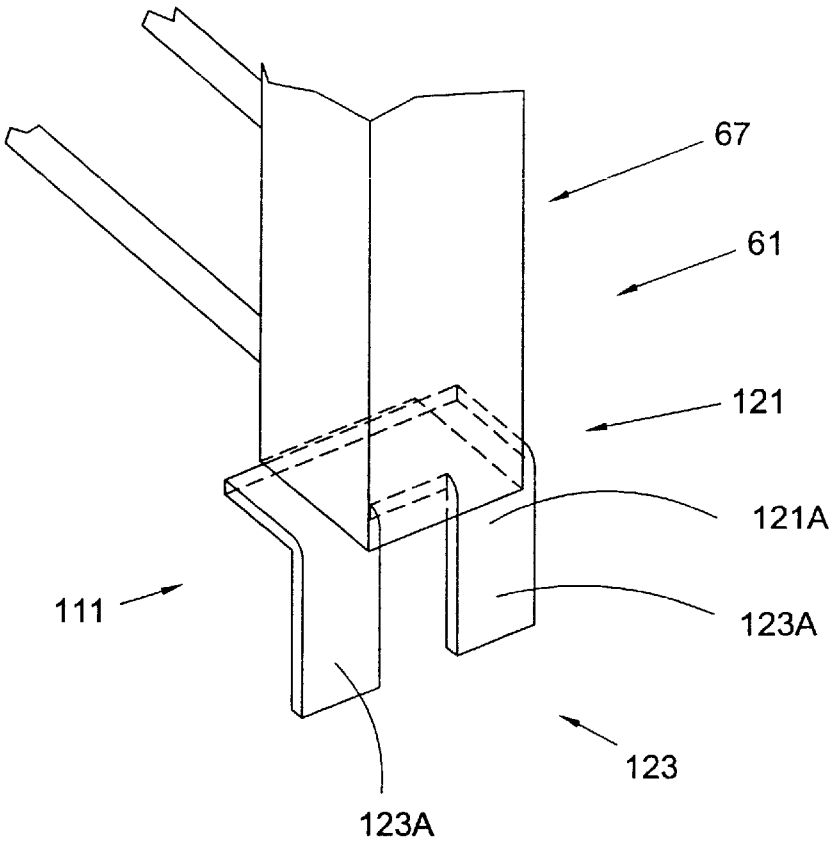
FIG. 8B is a perspective view of an embodiment of the lower bracket partially in phantom extending from a lower edge of an inner panel.
Figure 8A:
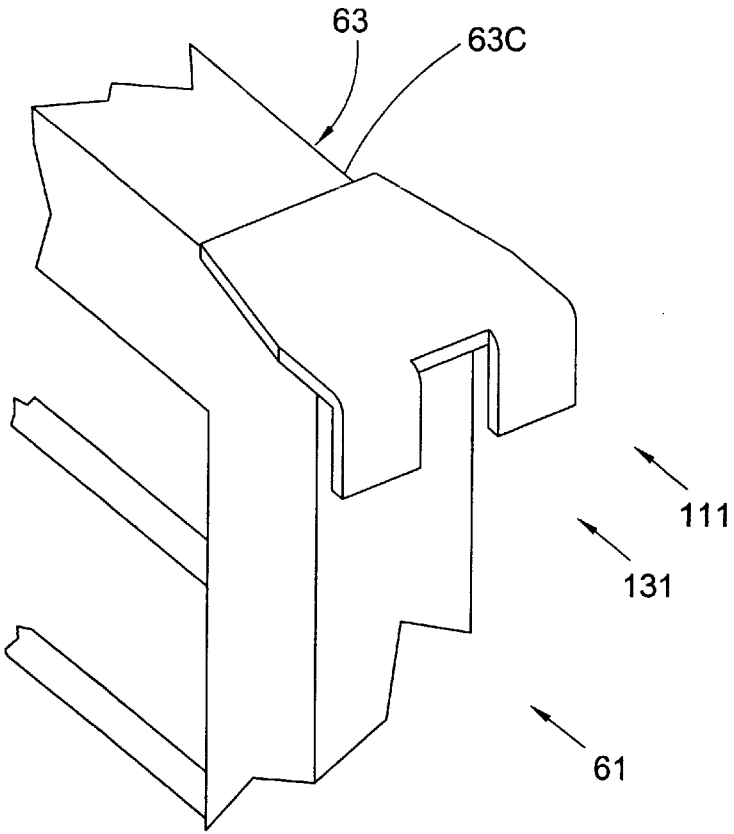
FIG. 8A is a perspective view of an embodiment of the upper bracket extending from an upper edge of an inner panel.

The embodiment of the system 21 illustrated in FIG. 4 includes a base 22 with panel securement apertures 41 arranged as in the FIGS. 3 and 7 embodiments and includes post apertures 42—opening through the base at the four corners 24C of the upper surface 25A generally adjacent to the base edges 24—and two sets 47 of opposing base bracket slots 45 that open though the upper base surface 25A and are aligned generally adjacent to but spaced from opposing edges 24 of the base 22 to form gap 25G. In this embodiment, two outer panels 71 are shown as releasably secured to the base 22 such that they are parallel to, but spaced apart from each other and an inner panel 81 secured to the base 22 and to the upper edges 63 of the outer panels 71 to form overall an "H" configuration. It is clear that the inner panel 81 can be easily repositioned such that the system 21 may form a "U" configuration, or other similar variant. The embodiment illustrated in FIG. 4 includes panels 61 having faces 62 that include an open grill work shelving/storage construction 62A that allows merchandise to displayed from the vertical panel in four dominant directions plus separate open surfaces 25A of the horizontal base wall 25 such that merchandise may also be carried on it or on which other displays, for example, a mannequin or smaller shelving systems or promotional items, may be supported.

Another embodiment of the system 21 is illustrated in FIG. 5. This embodiment, like the embodiments illustrated in FIGS. 1, 2, and 6, includes post apertures 42—that open generally adjacent to each of the corners 24C of the base edge 24 and the midway point 22C from two opposing edges 24 of the base 22—, bracket slots 45, a set 47 of which is aligned in a position inward from and along each base edge 24 and inward from each post aperture 42 and another two sets 47 of which are aligned opposing each other generally adjacent to a line running bisecting the upper surface 25A of the base 22 generally adjacent to the midway point 22C. The base 22 allows up to three outer panels 71 and one or more inner panels 81 to be releasably secured to the base 22. The system 21 as illustrated in FIG. 5 includes one outer panel 71—releasably secured, to the base through insertion of the post extensions 115 in the post apertures 42 midway along opposing edges of the base 22—and an inner panel 81—sized and shaped and including an upper bracket 131 affixed to one corner 63C of the inner panel upper edge 63 so that the panel 81 may be releasably secured perpendicular to and midway along the face of the positioned outer panel 71 by receipt of the bracket 131 within panel bracket slots 69 opening within the upper edge 63 of the outer panel 71. The panels 61 of the FIG. 5 system configuration include faces 62 having an open grill work shelving/storage construction 62A by which a variety of other hardware may be attached to the system 21.

The embodiment of the system 21 shown in FIG. 6 includes two outer panels 71—each post extension 115 of which is positioned to be inserted into post apertures 42 along opposing edges 24 of the base 22—and two inner panels—each of which is positioned to be releasably secured to the base surface 25A and to the upper edge 63 of the outer panel 71 by receipt of their base brackets 121 into the base slots 45 and their upper brackets 131 into upper edge bracket slots 69 of the outer panels 71—such that the post of the inner panels 81 are generally flush with the edges 66 of the post 67 of the outer panel 71. The system with resultant walled space 201 can be used without any additional hardware—such as shelving—as a bin to store and/or display for example, items or merchandise in a loose fashion or animate objects, such as pets, that may off the base surface 25A unless otherwise confined. The grill-like shelving/storage construction 62A of the panels 61 in this embodiment is further advantageous in such applications in that, for example, consumers may largely see through the panels to identify and view the confined merchandise.

The embodiment of the, present invention illustrated in FIG. 7 includes two outer vertical panels 71 and two inner vertical panels 81, one of which is largely not of the same vertical height as the other inner panel 81 or the other outer panel 71. The vertically-shortened vertical panel 81 includes an upper bracket 131 affixed to the upper edge corner 63C of a generally vertical arm 138 that is a vertical extension of the post 67 such that the engaging components of the upper bracket 131 may be releasably secured in outer panel bracket slots 69 opening through the upper edge 63 of the outer panel 61. The FIG. 7 embodiment is shown with one of the many horizontal display units 151 that are easily attachable to the vertical panels 61—a shelf 153 with brackets 155 sized and shaped for attachment to the shelving/storage construction 62A—such that shelving or other storage or display space may be thereby formed. By inserting the modular components as shown in FIG. 7, space 201 is also formed that, as stated above, is useful for housing objects that are loose and bulky and/or animate objects that can move and thereby need to be confined. Caster wheels 171 are shown in position for attachment to the base 22 to facilitate the systems movement.

While a number of configurations are shown and discussed above, it will be readily appreciated that the panels may be organized on the base to form other configurations. It will be also understood that the embodiments of the present invention which have been described are illustrative of some of the applications of the principles of the present invention. Numerous modifications may be made by those skilled in the art without departing from the true spirit and scope of the invention.

What is claimed is:

1. A shelving/storage system comprising:

a base having a substantially horizontal upper surface with an outer edge;

a pair of opposing panel posts, each panel post having a lower end;

an outer panel extending between the pair of opposing panel posts, said outer panel including upper edge bracket slots;

a plurality of first post apertures located within the substantially horizontal upper surface adjacent the outer edge, each first post aperture sized and shaped to removably receive the lower end of a panel post;

an inner panel including one or more lower brackets extending from an inner panel lower surface and one or more upper brackets extending from an inner panel upper surface and sized and shaped to be inserted into said upper edge bracket slots; and a plurality of base slots in said upper surface sized and shaped to receive said lower brackets whereby said inner panel may be secured to said base.

2. A shelving/storage system comprising:

a base having a substantially horizontal upper surface with an outer edge;

a pair of opposing panel posts, each panel post having a lower end;

an outer panel extending between the pair of opposing panel posts;

two sets of a plurality of first post apertures located within the substantially horizontal upper surface adjacent the outer edge, each of the sets of first post apertures co-linear and each first post aperture sized and shaped to receive the lower end of a corresponding panel post; and two sets of a plurality of second apertures located within the substantially horizontal upper surface, each of the sets of second apertures disposed inwardly from a line defined by the inner edges of one of the sets of first post apertures, the second apertures sized and shaped to receive and support an inner panel.

3. The shelving/storage system as defined in claim 2 further comprising an inner panel having lower brackets sized and shaped to be inserted into one or more of said second apertures whereby the inner panel may be secured to said base.

4. The shelving/storage system as defined in claim 3 wherein said outer panel further includes upper edge bracket slots.

5. The shelving/storage system of claim 3 wherein the inner panel comprises a slatwall.

6. The shelving/storage system of claim 3 wherein the inner panel comprises a grid.

7. The shelving/storage system of claim 2 wherein each panel post lower end comprises a post extension.

8. The shelving/storage system of claim 2 wherein the outer panel comprises a grid.

9. The shelving/storage system of claim 2 wherein the outer panel is adapted to support a store fixture.

10. The shelving/storage system of claim 2 wherein the outer panel comprises a slatwall.

11. A shelving/storage system comprising:

a base having a substantially horizontal upper surface with an outer edge;

a pair of opposing panel posts, each panel post having a lower end;

an outer panel extending between the pair of opposing panel posts;

a plurality of first post apertures located within the substantially horizontal upper surface adjacent the outer edge, each first post aperture sized and shaped to removably receive the lower end of a panel post;

an inner panel having one or more lower brackets; and a plurality of second post apertures located within the substantially horizontal upper surface, each second post aperture sized and shaped to removably receive said lower brackets;

wherein the inner panel has one or more upper brackets adapted to removably secure the inner panel to the outer panel.

12. The shelving/storage system of claim 11 wherein the outer panel has an upper edge including a plurality of apertures adapted to receive the brackets of the inner panel for removably securing the inner panel to the outer panel.

13. A shelving/storage system comprising:

a base having a substantially horizontal surface defining an outer edge;

an inner panel having lower attachment members;

an outer panel having lower attachment members;

two sets of a plurality of first apertures in the base surface adjacent the edge of the base for removably receiving the lower attachment members of the outer panel, each of the sets of first apertures co-linear; and two sets of a plurality of second apertures in the base surface disposed inwardly from the edge of the base for removably receiving the lower attachment members of the inner panel, each of the sets of second apertures disposed inwardly from a line defined by the inner edges of one of the sets of first apertures.

14. The shelving storage/system of claim 13 wherein the lower attachment members of the outer panel comprise a post and the plurality of first apertures are sized and shaped to removably receive the post.

15. The shelving/storage system of claim 13 wherein the inner panel has one or more brackets adapted to removably secure the inner panel to the outer panel.

16. The shelving/storage system of claim 13 wherein the lower attachment members of the inner panel comprise one or more brackets adapted to removably fit in the second apertures to secure the inner panel to the base.

17. The shelving storage/system of claim 13 wherein the outer panel is adapted to support a store fixture.

18. The shelving storage/system of claim 17 wherein the inner panel is adapted to support a store fixture.

19. A shelving/storage system comprising:

a base having a substantially horizontal surface defining an outer edge;

an inner panel having lower attachment members and one or more upper brackets;

an outer panel having lower attachment members;

a plurality of first apertures in the base surface adjacent the edge of the base for removably receiving the lower attachment members of the outer panel; and a plurality of second apertures in the base surface disposed inwardly from the edge of the base for removably receiving the lower attachment members of the inner panel;

wherein the outer panel has an upper edge including a plurality of apertures adapted to receive the upper brackets of the inner panel to removably secure the inner panel to the outer panel.

* * * * *